US005988273A

United States Patent [19]

Monjure et al.

[11] Patent Number: 5,988,273

[45] Date of Patent: Nov. 23, 1999

[54] COILED TUBING COMPLETION SYSTEM

[75] Inventors: Noel A. Monjure, Houston, Tex.; Thomas A. Thevenet, Breaux Bridge, La.

[73] Assignee: ABB Vetco Gray Inc., Houston, Tex.

[21] Appl. No.: 09/140,601

[22] Filed: Aug. 26, 1998

Related U.S. Application Data

[60] Provisional application No. 60/056,301, Sep. 30, 1997.

[51] Int. Cl.[6] ..... E21B 33/04

[52] U.S. Cl. ..... 166/75.14; 166/88.2

[58] Field of Search ..... 166/75.14, 88.2, 166/88.4, 96.1, 77.2, 208, 382

[56] References Cited

U.S. PATENT DOCUMENTS

| | | | |
|---|---|---|---|
| 3,373,816 | 3/1968 | Cochran . | |
| 3,675,719 | 7/1972 | Slator et al. . | |
| 3,690,381 | 9/1972 | Slator et al. . | |
| 3,827,487 | 8/1974 | Jackson et al. . | |
| 3,866,679 | 2/1975 | Laky . | |
| 4,844,166 | 7/1989 | Going, III et al. . | |
| 5,092,400 | 3/1992 | Jagert . | |
| 5,467,825 | 11/1995 | Vallet . | |
| 5,515,925 | 5/1996 | Boychuk . | |
| 5,515,926 | 5/1996 | Boychuk . | |
| 5,522,464 | 6/1996 | Piper . | |
| 5,544,706 | 8/1996 | Reed . | |
| 5,725,056 | 3/1998 | Thomson | 166/382 |
| 5,727,631 | 3/1998 | Baker et al. . | |

OTHER PUBLICATIONS

Walker VCT Clamp Style Coiled Tubing Hanger (Undated).

*Primary Examiner*—David Bagnell
*Assistant Examiner*—Zakiya Walker
*Attorney, Agent, or Firm*—James E. Bradley

[57] ABSTRACT

A coiled tubing completion system has a gripping mechanism on a lower end which land in a tubing hanger and engage coiled tubing extending through the tubing hanger. A tubular member is located above the gripping member and receives the upper end of the tubing. A tapered metal seal seals between the tubular member and the coiled tubing. A threaded nut, when rotated, causes the seal to energize.

25 Claims, 3 Drawing Sheets

COILED TUBING COMPLETION SYSTEM

This application claims the benefit of provisional application Ser. No. 60/056,301, filed on Sep. 3, 1997, in the U.S. Patent & Trademark Office.

TECHNICAL FIELD

This invention relates in general to completion systems and in particular to a coiled tubing high pressure completion system.

BACKGROUND ART

In certain wells, coiled tubing is used as a conduit to retrieve production fluids. Coiled tubing is a continuous flexible metal tube that is unwound from a large reel and forced into the well. Coiled tubing requires a completion system having a specialized tubing hanger which suspends the coiled tubing in the well.

Typically, prior art coiled tubing hangers have a mechanism such as a clamp for gripping the coiled tubing to support its weight and prevent its downward movement. The tubing hangers also have some type of elastomeric seal such as O-rings to seal around the exterior surface of the coiled tubing. Although these designs are workable, an improved coiled tubing completion system is desirable, particularly for higher pressures.

DISCLOSURE OF THE INVENTION

A coiled tubing completion system has a gripping mechanism on a lower end which land in a tubing hanger and engage coiled tubing extending through the tubing hanger. A seal carrier lands on top of and abuts an upper end of the gripping mechanism. A tubular member is located above the seal carrier and receives the upper end of the tubing. A tapered metal seal seals between the tubular member and the coiled tubing. A threaded nut bears against the metal seal and, when rotated, results in downward movement of the tubular member. The seal prevents fluid leakage in the system at the upper end of the tubing.

BEST MODE FOR CARRYING OUT THE INVENTION

Figure 1:
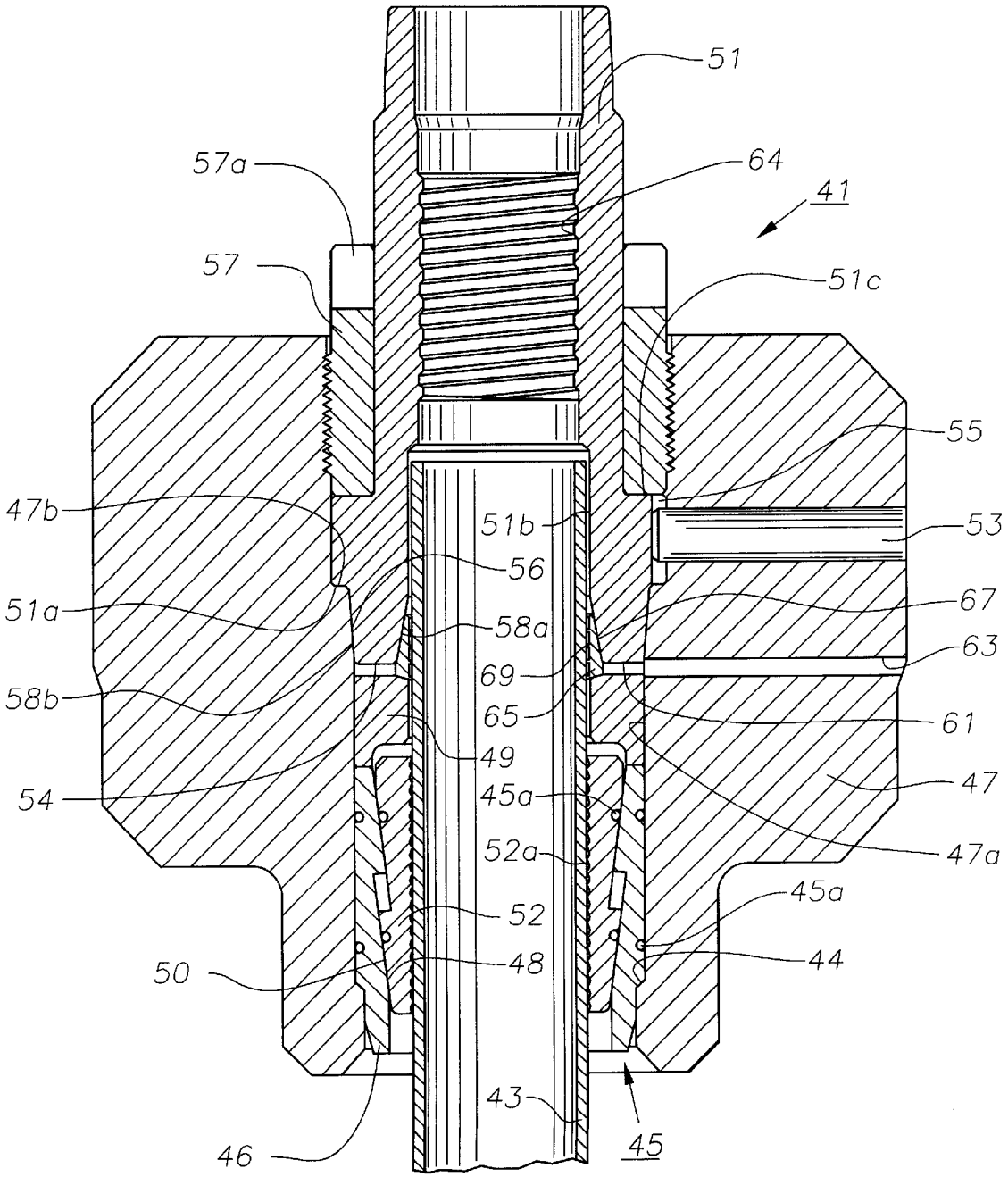
FIG. 1 is a sectional side view of a coiled tubing completion system constructed in accordance with a first embodiment of the invention.

Referring to FIG. 1, a first embodiment of the invention is shown. A coiled tubing completion system 41 has slips 45 on a lower end which land on a shoulder 44 in the bore 47*a* of a housing or tubing hanger 47. In the embodiment shown, tubing hanger 47 is landed sealingly in a wellhead (not shown). Slips 45 comprises an outer slip body 46 with upward inclined surfaces 48 which engage downward inclined surfaces 50 on an inner slip ring 52. Slip ring 52 is a solid metal ring which will deform radially inward a slight amount when moving downward on body 47. Slips 45 has a plurality of O-ring seals 45*a* for sealing between slip body 46, slip ring 52 and bore 47*a*. Slip ring 52 has upward facing teeth 52*a* on an interior surface which engage an outer surface of coiled tubing 43 near its upper end to prevent its downward movement. Teeth 52*a* are parallel and circumferential.

A seal carrying member 49 lands on top of and abuts an upper end of slip body 46. A tubular energizing member 51 is located above seal carrier 49 in bore 47*a*. Member 51 has an external shoulder 51*a* which lands on an internal shoulder 47*b* in bore 47*a*. Member 51 has a bore 51*b* which receives the upper end of coiled tubing 43. A pin 53 inserts horizontally through tubing hanger 47 and engages a recess 55 on a perimeter of member 51 to prevent its rotation relative to tubing hanger 47. A nut 57 having lugs 57*a* and external threads which engage internal threads in tubing hanger 47 is located above pin 53 and surrounds member 51. Nut 57 engages an upward facing external shoulder 51*c* near the lower end of member 51. The interior of the lower end of member 51 has a conical taper 58*a*. The exterior of the lower end of member 51 has a conical taper 58*b* which mates with a taper 56 formed in tubing hanger bore 47*a*, forming a metal-to-metal sealing engagement. Taper 58*a* is more inclined than taper 58*b* relative to tubing 43. Member 51 also has a rim 54 extending between tapers 58*a*, 58*b* which is parallel to and spaced above the upper end of seal carrier 49. An annular space 61 is located between rim 54 and the upper end of seal carrier 49. A test port 63 extends laterally through tubing hanger 47 and registers with space 61. Member 51 has a threaded profile 64 in its bore which optionally may receive a back pressure valve (not shown).

A metal seal 65 having a generally triangular cross-sectional shape is located in a space between the upper end of seal carrier 49, taper 58*a* and tubing 43. Seal 65 has a conical exterior 67 which engages taper 58*a*, and a cylindrical bore 69 with circular metal ribs which engage coiled tubing 43. A soft metal inlay may be filled between the ribs. Seal 65 prevents fluid leakage in system 41 at the upper end of tubing 43.

In operation, slips 45 are set in tubing hanger 47 to receive and support coiled tubing 43. Seal carrier 49, seal 65 and member 51 are then consecutively placed in bore 47*a*, with tapers 58*b*, 56 making metal-to-metal contact. Nut 57 is tightened relative to member 51, thereby forcing member 51 further downward. Tapers 58*a*, 58*b* are moved into sliding contact with conical exterior 67 and taper 56, respectively, until downward movement of member 51 ceases. This motion energizes seal 65 by sealing cylindrical bore 69 against coiled tubing 43 and conical exterior 67 against taper 58*a*. The ribs in bore 69 deform and seal 65 against coiled tubing 43. A metal-to-metal seal is formed at tapers 58*a*, 67 and at 58*b*, 56. The seals 45*a* in slips 45 and teeth 52*a* seal the lower end of bore 47*a*, while tapers 58*b*, 56 and ribs in bore 69 seal the upper end of bore 47*a*. Seal 65 may be tested for leakage by applying fluid pressure through test port 63 and space 61.

Figure 2:
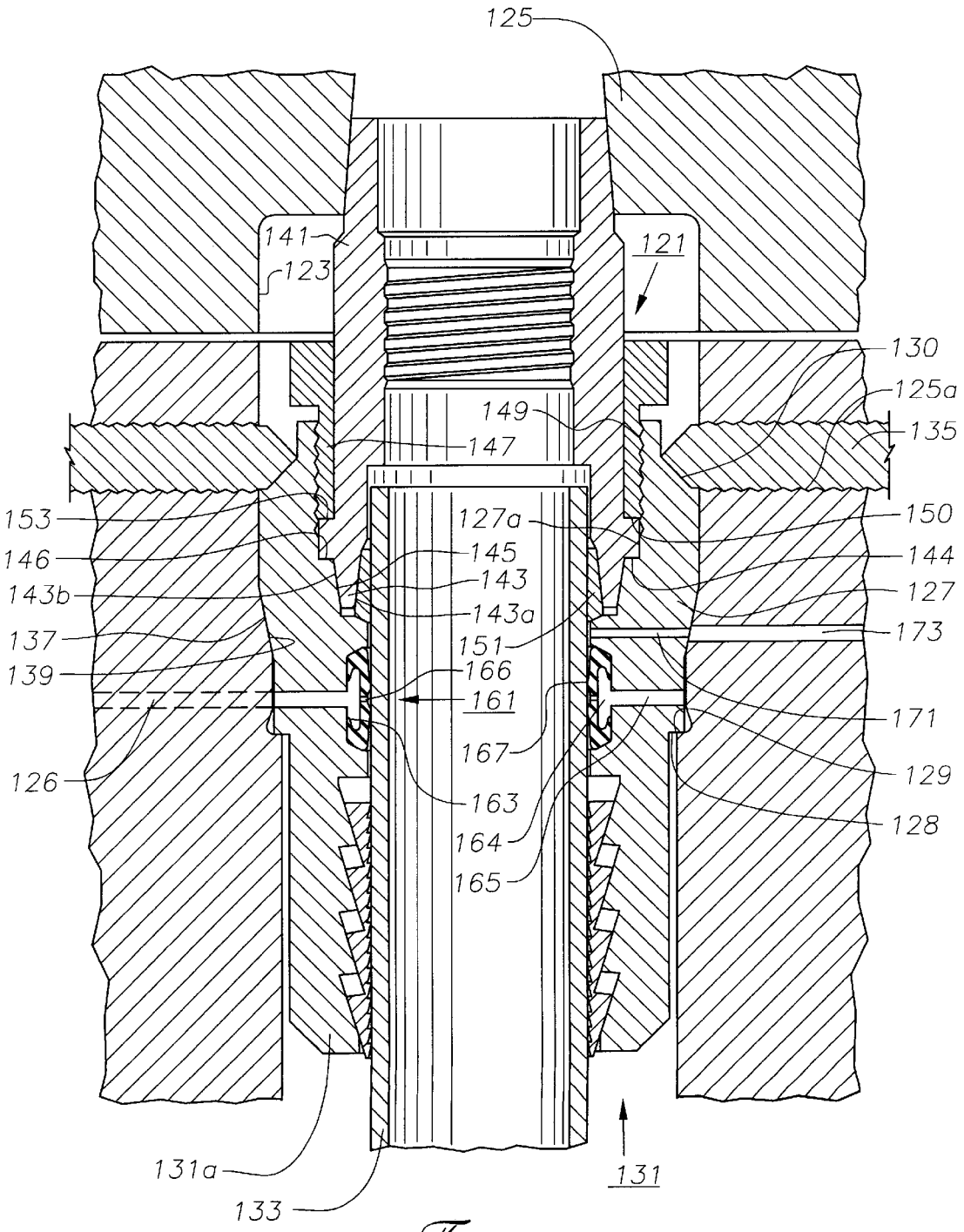
FIG. 2 is a sectional side view of a second embodiment of the completion system of FIG. 1.

Referring to FIG. 2, a second embodiment of the invention is shown. A coiled tubing completion system 121 is supported within the bore 123 of a wellhead or spool 125 with a housing or tubing hanger 127. Tubing hanger 127 has an external shoulder 128 which lands on an internal shoulder 129 in bore 123. A conventional slips 131 is carried within a slips bowl 131*a* formed on a lower end of tubing hanger 127. Slips 131 engages coiled tubing 133 along a lower, internal end of tubing hanger 127 so that tubing hanger 127 surrounds an upper end of coiled tubing 133. Unlike slips 45 of FIG. 1, slips 131 are split and do not contain seals. Tubing hanger 127 is secured within wellhead 125 with studs 135. Studs 135 thread horizontally through slots 125*a* in wellhead 125 and have conical heads which engage a shoulder 130 on tubing hanger 127. Studs 135 force tubing hanger 127 downward to seal its outer taper 137 with an inner taper 139 in bore 123.

An energizing member 141 is lowered into an upper end of tubing hanger 127. Member 141 has lower depending conical lip 143 which is received by a conical bore 145 in tubing hanger 127. Lip 143 has an inner taper 143*a* and an outer taper 143*b* that are inclined at approximately equal angles. Member 141 has a stop shoulder 144 which bottoms out on a shoulder 146 in bore 127*a*. A metal seal 151 is located in an annular space between inner taper 143*a* and an outer surface of coiled tubing 133. A nut 147 having external threads and a smooth inner surface engages an internal threaded surface 149 on tubing hanger 127. A lower rim 150 of nut 147 lands on an external flange 153 on member 141. A key (not shown) prevents member 141 from rotating relative to nut 147.

System 141 has a back-up seal in the form of a self-energizing, elastomeric, C-shaped channel seal 161 with fingers 163 on an outer diameter. Seal 161 is located in an internal recess in tubing hanger 127 above slips 131. Seal 161 is resilient and deflects radially inward into contact with coiled tubing 133 with a pair of ribs or protuberances 167 on an inner diameter. Fingers 163 extend toward one another and are in contact with tubing hanger 127 to define a cavity 164.

In operation, system 141 is set with slips 131, seals 151, 161 and member 141 as described above. Seal 161 and fingers 163 seal against tubing hanger 127 and protuberances 167. Nut 147 is tightened so that rim 150 makes contact with flange 153, thereby forcing member 141 downward. Tapers 143*a*, 143*b* slidingly engage seal 151 and conical bore 145, respectively. Further tightening of nut 147 squeezes seal 151 between taper 143*a* and coiled tubing 133 so that a seal against internal pressure in coiled tubing 133 is formed. Elastomeric seal 166 serves as a back-up seal. Tapers 137, 139 combine with tapers 143, 145*b* and seal 151 to form metal-to-metal seals to seal against any pressure in the annulus surrounding coiled tubing 133. In this embodiment, member 141 may be removed while a full annulus seal is maintained at shoulders 137, 139.

Seal 161 may be tested under fluid pressure applied through a passage 126 in wellhead 125 which registers with a passage 165 which extends horizontally through tubing hanger 127, and a hole 166 which extends through seal 161 between protuberances 167. Both of seals 151, 161 may be tested under fluid pressure applied through a test port 171 in wellhead 125 which registers with a passage 173 which extends horizontally through tubing hanger 127.

Figure 3:
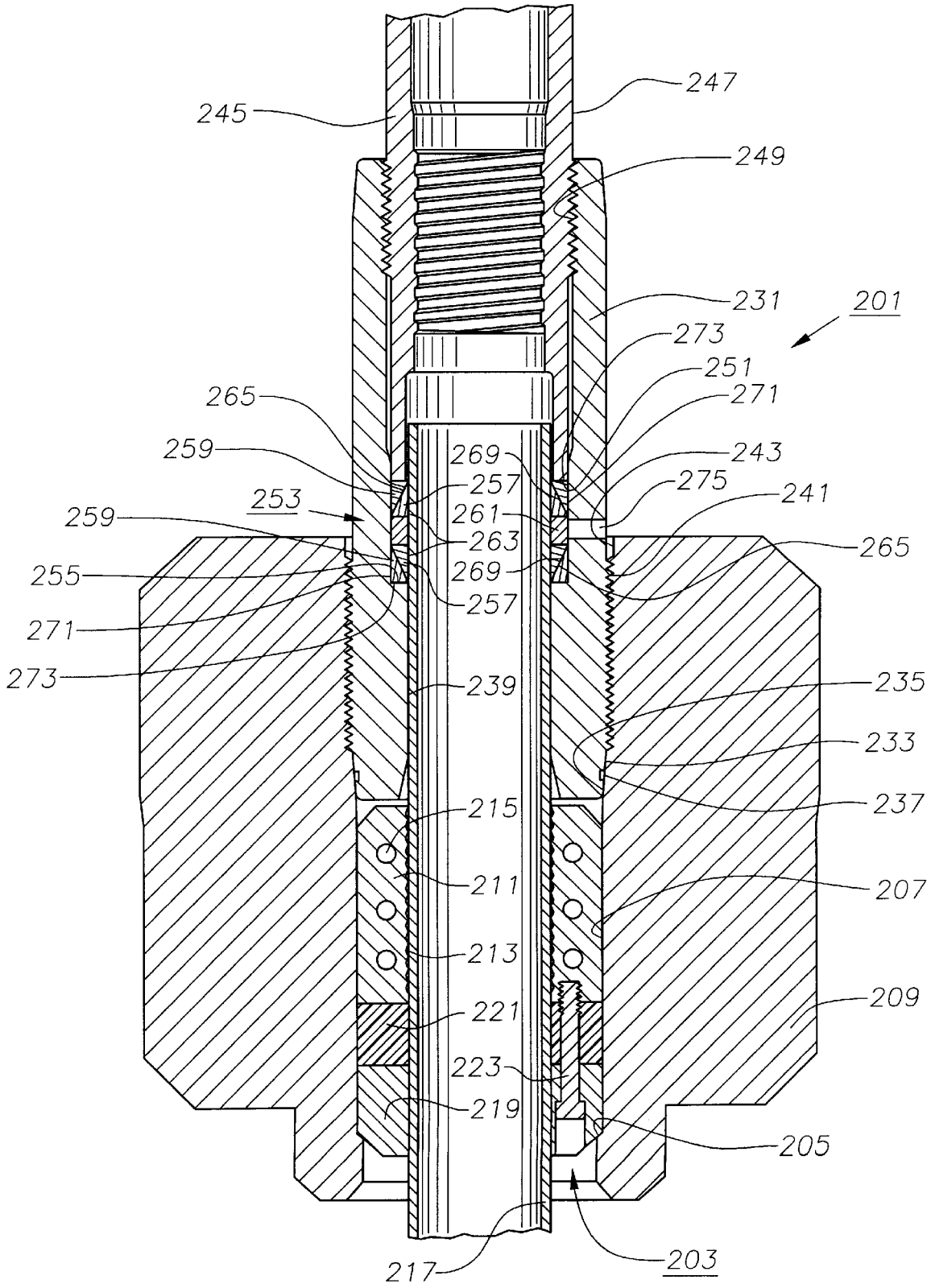
FIG. 3 is a sectional side view of a third embodiment of the completion system of FIG. 1.

Referring to FIG. 3, a third embodiment of the invention is shown. A coiled tubing completion system 201 has a clamp or gripping member 203 on a lower end which lands on a shoulder 205 in the bore 207 of a housing or tubing hanger 209. Tubing hanger 209 is landed in a wellhead (not shown). Gripping member 203 comprises a split, two-piece tubular body 211 with upward facing teeth 213 on an inner surface. The pieces of body 211 are secured to one another with fasteners 215. Teeth 213 engage the outer surface of coiled tubing 217 to prevent its downward movement. Gripping member 203 has a tubular lower member 219 which lands on shoulder 205. Gripping member 203 also has an optional elastomeric seal 221 for sealing between body 211, lower member 219 and bore 207. At least one fastener 223 is used to join body 211, lower member 219 and seal 221 together.

A tubular member 231 is located above gripping member 203 in bore 207. Member 231 has an external taper 233 which lands on an internal taper 235 in bore 207 and forms a metal seal. An O-ring 237 may serve as a back-up to the seal between tapers 233, 235. Member 231 has a bore 239 on a lower end which closely receives the upper end of coiled tubing 217. Tubular member 231 has exterior threads 241 to secure it to tubing hanger 209. A tubular energizing member 245 having external threads 247 which engage internal threads 249 in member 231 extends through the upper end of member 231 and surrounds the upper end of coiled tubing 217. A lower rim 251 of energizing member 245 lands on an upper surface of a metal compression seal 253.

Continuing to refer to FIG. 3, seal 253 has a generally cylindrical overall shape and is located in a space between a shoulder 255 in member 231 and rim 251 on energizing member 245. In the embodiment shown, compression seal 253 comprises five separate elements which combine to prevent fluid leakage between coiled tubing 217, member 231 and energizing member 245.

Seal 253 has two conical inner rings 257, two conical outer rings 259 and a cylindrical spacer 261. Each inner ring 257 is paired with one outer ring 259, and spacer 261 is centrally located between the matched pairs of rings 257, 259. The inner rings 257 are inverted relative to one another and to the outer rings 259. Outer rings 259 are also inverted relative to one another. To achieve this configuration, each inner ring 257 has a cylindrical inner surface 263, a conical outer surface 265 and a horizontal surface 267. Inner surfaces 263 abut the outer surface of coiled tubing 217 while horizontal surfaces 267 abut upper and lower surfaces of spacer 261, respectively. Conical outer surfaces 265 slidingly engage their respective conical inner surfaces 269 on outer rings 259. Each ring 259 also has a cylindrical outer surface 271 and a horizontal surface 273. Outer surfaces 271 abut bore 239 of member 231 while horizontal surfaces 273 abut rim 251 and shoulder 255, respectively. A test port 275 extends laterally through member 231 and registers with spacer 261.

In operation, gripping member 203 is clamped around coiled tubing 217 and set in tubing hanger 209 to support coiled tubing 217. Member 231 is then screwed into tubing hanger 209. Seal 253 and energizing member 245 are then consecutively placed in bore 207, with seal 253 making metal-to-metal contact with coiled tubing 217 and member 231. Energizing member 245 is tightened relative to member 231, thereby compressing seal 253 between coiled tubing 217 and member 231. As seal 253 is compressed, each matched set of rings 257, 259 move relative to one another along conical surfaces 265, 269, respectively. This motion energizes seal 253 and seals cylindrical inner surfaces 263 against coiled tubing 217 and cylindrical exterior outer surfaces 271 against member 231. The upper ring 257 of seal 253 is a primary metal seal against internal pressure in coiled tubing 217. The lower ring 257 of seal 253 is a back-up seal and allows testing of the upper ring 257 by applying test pressure through test port 275. The annulus around coiled tubing 217 is sealed by metal-to-metal sealing at tapers 235, 237.

The invention has significant advantages. The embodiments describe improved completion systems having durable metal-to-metal seals for sealing coiled tubing in a tubing hanger. For example, the clamp-type gripping mechanism of FIG. 3 could be used in place of the slips in the first two embodiments. The tubing hanger housing could be an external part of a wellhead system and not necessarily located within a bore of a spool.

While the invention has been shown or described in only some of its forms, it should be apparent to those skilled in the art that it is not so limited, but is susceptible to various changes without departing from the scope of the invention.

We claim:

1. A system for completing a coiled tubing production operation, comprising:

a housing having a bore;

a landing shoulder in the bore;

a seal surface in the bore;

a gripping mechanism which grips the coiled tubing and lands on the landing shoulder;

a metal tubular member having a seal surface on its exterior which engages the seal surface in the bore;

a metal seal abutting the tubular member that sealingly engages the coiled tubing;

a test port extending laterally through the tubular member below at least a portion of the metal seal for testing the metal seal;

a back-up seal member located below the metal seal and the test port to enable test pressure to be applied from below the seal; and an energizing member located within the housing and axially moveable relative to the housing and the seal for energizing the metal seal against the coiled tubing.

2. The system of claim 1 wherein the gripping member comprises slips.

3. The system of claim 1 wherein the gripping member comprises a clamp.

4. A system for completing a coiled tubing production operation, comprising:

a housing having a bore;

a landing shoulder in the bore;

a tapered seal surface in the bore above the landing shoulder;

a gripping mechanism which grips the coiled tubing and lands on the landing shoulder;

a metal tubular member having a tapered seal surface on its exterior which engages the seal surface in the bore to form a metal-to-metal seal;

a seal cavity on an interior of the tubular member;

a metal seal ring located in the seal cavity;

an energizing member located within the housing and axially moveable relative to the housing and the seal ring for energizing the seal ring against the coiled tubing; and a test port extending laterally through the tubular member below at least a portion of the metal seal ring and above the tapered seal surfaces for testing the metal seal ring.

5. The system of claim 4, further comprising a back-up seal member located below the seal ring and the test port to enable test pressure to be applied from below the seal ring.

6. The system of claim 5 wherein the back-up seal member is an elastomeric seal on the gripping member.

7. The system of claim 5 wherein the back-up seal member is an elastomeric seal located between the tubular member and the coiled tubing.

8. The system of claim 5 wherein the seal ring and the back-up seal member are part of a compression seal assembly having two pairs of rings separated by a central spacer, each of the pairs having mating wedge surfaces; and wherein the seal ring comprises one of the pairs of rings and the back-up seal member comprises the other of the pairs of rings.

9. The system of claim 4, further comprising:

a key to prevent rotation of the tubular member relative to the housing; and a nut which engages threads in the housing and moves the tubular member downward.

10. A system for completing a coiled tubing production operation, comprising:

a housing having a bore;

a landing shoulder in the bore;

a tapered seal surface in the bore above the landing shoulder;

a gripping mechanism which grips the coiled tubing and lands on the landing shoulder;

a metal tubular member having a tapered seal surface on its exterior which engages the seal surface in the bore to form a metal-to-metal seal;

a seal cavity on an interior of the tubular member;

a metal seal ring located in the seal cavity; and an energizing member located within the housing and axially moveable relative to the housing and the seal ring, wherein the seal ring has an outer tapered surface to cause it to move inward upon downward movement of the energizing member.

11. A system for completing a coiled tubing production operation, comprising:

a housing having a bore;

a landing shoulder in the bore;

a tapered seal surface in the bore above the landing shoulder;

a gripping mechanism which grips the coiled tubing and lands on the landing shoulder;

a metal tubular member having a tapered seal surface on its exterior which engages the seal surface in the bore to form a metal-to-metal seal;

a seal cavity on an interior of the tubular member;

a metal seal ring located in the seal cavity; and an energizing member located within the housing and axially moveable relative to the housing and the seal ring, wherein a lower end of the energizing member has an inner taper and an outer taper, the inner taper engaging the seal ring and the outer taper engaging a mating taper in the tubular member.

12. A system for completing a coiled tubing production operation, comprising:

a housing having a bore;

a landing shoulder in the bore;

a tapered seal surface in the bore above the landing shoulder;

a gripping mechanism which grips the coiled tubing and lands on the landing shoulder;

a metal tubular member having a tapered seal surface on its exterior which engages the seal surface in the bore to form a metal-to-metal seal;

a seal cavity on an interior of the tubular member;

a metal seal ring located in the seal cavity; and an energizing member located within the housing and axially moveable relative to the housing and the seal ring for energizing the seal ring against the coiled tubing, wherein the energizing member has external threads which engage mating threads in the tabular member.

13. A system for completing a coiled tubing production operation, comprising:

a housing having a bore;

a string of coiled tubing extending into the bore;

a landing shoulder in the bore;

a tapered seal surface in the bore above the landing shoulder;

a gripping mechanism which grips the coiled tubing and lands on the landing shoulder;

a metal tubular member having a tapered seal surface on its exterior which engages the seal surface in the bore to form a metal-to-metal seal;

a seal cavity on an interior of the tubular member;

a metal seal ring located in the seal cavity;

an energizing member which is axially movable relative to the housing and the seal ring and energizes the seal ring against the coiled tubing;

a test port extending laterally through the tubular member below at least a portion of the seal ring and above the tapered seal surfaces for testing the seal ring; and a back-up seal member located below the seal ring and the test port to enable test pressure to be applied between the seal ring and the back-up seal member.

14. The system of claim 13 wherein the back-up seal member is an elastomeric seal on the gripping member.

15. The system of claim 13 wherein the back-up seal member is an elastomeric seal between the tubular member and the coiled tubing.

16. The system of claim 13 wherein the seal ring and the back-up seal member are part of a compression seal assembly having two pairs of rings separated by a central spacer, each of the pairs having mating wedge surfaces; and wherein the seal ring comprises one of the pairs of rings and the back-up seal member comprises the other of the pairs of rings.

17. The system of claim 13 wherein the seal ring has an outer tapered surface to cause it to move inward upon downward movement of the energizing member.

18. The system of claim 13 wherein the energizing member has external threads which engage mating threads in the tubular member.

19. The system of claim 13 wherein the gripping member comprises slips.

20. The system of claim 13 wherein the gripping member comprises a clamp.

21. The system of claim 13 wherein a lower end of the energizing member has an inner taper and an outer taper, the inner taper engaging the seal ring and the outer taper engaging a mating taper in the tubular member.

22. A system for completing a coiled tubing production operation, comprising:

a housing having a bore;

a landing shoulder in the bore;

a tapered seal surface in the bore above the landing shoulder;

a gripping member landed in the bore of the housing below the seal surface for preventing downward movement of a coiled tubing;

a tubular member extending into the bore of the housing, the tubular member having a bore for receiving an upper end of the coiled tubing;

a taper on a lower end of the tubular member for sealing against the tapered seal surface in the bore of the housing;

a metal seal located in the bore in the tubular member for sealing against the coiled tubing; and an energizing member which engages threads in the tubular member for forcing and energizing the metal seal into engagement with the coiled tubing.

23. The system of claim 22 wherein the metal seal comprises two pairs of rings, the pairs being separated by a central spacer, each of the pairs comprising inner and outer rings which have wedge surfaces that slidingly engage each other.

24. The system of claim 23, further comprising a test port extending through the tubular member between the two pairs of rings for testing the metal seal.

25. The system of claim 22 wherein the tubular member has threads on its exterior which engage threads in the bore of the housing.

* * * * *